United States Patent [19]

Lowman

[11] Patent Number: 4,591,051

[45] Date of Patent: May 27, 1986

[54] BILLIARD BALL AND RACK STORAGE CASE

[76] Inventor: Michael E. Lowman, 29 Rose Ct., Narragansett, R.I. 02882

[21] Appl. No.: 726,654

[22] Filed: Apr. 23, 1985

[51] Int. Cl.[4] ..... B65D 85/58

[52] U.S. Cl. ..... 206/315.9; 206/315.1; 206/579; 273/22

[58] Field of Search ..... 206/315.9, 315.1, 579, 206/561, 559, 551; 211/14; 273/22; D21/232

[56] References Cited

U.S. PATENT DOCUMENTS

| | | | |
|---|---|---|---|
| 294,200 | 2/1884 | Collender | 273/22 |
| 1,052,461 | 2/1913 | Chase | 273/22 |
| 1,093,123 | 4/1914 | Goyette | 273/22 |
| 1,887,552 | 11/1932 | Gunn | 273/22 |
| 3,236,519 | 2/1966 | Leigh | 211/14 |
| 3,627,321 | 12/1971 | Sardo | 273/22 |
| 3,672,671 | 6/1972 | Merola | 273/22 |
| 3,794,319 | 2/1974 | Miller | 273/22 |
| 3,929,333 | 12/1975 | Kremski | 273/22 |
| 4,103,773 | 8/1978 | Haber | 206/315.9 |

*Primary Examiner*—William Price
*Assistant Examiner*—Brenda J. Ehrhardt
*Attorney, Agent, or Firm*—Robert J. Doherty

[57] ABSTRACT

A combination billiard ball and rack storage case for storing and carrying such balls and rack. The case includes an open bottom box-like cover adapted for placement over the balls and having means for holding the rack proximal an upper wall. A slidable bottom wall is used to close the cover and force the balls in a snug position against the cover upper wall and a plate which in combination assures rattle-free retention of the balls and rack in the case.

4 Claims, 7 Drawing Figures

BILLIARD BALL AND RACK STORAGE CASE

BACKGROUND AND OBJECTS OF THE INVENTION

This invention relates to pool or pocket billiards and more particularly to a convenient accessory and its means of operation whereby billiard balls may be easily removed and replaced from a billiard table and stored while not in use in conjunction therewith.

It should be brought out that the term "billiard" as used hereinafter refers to not only the game of billiards and the equipment used in association therewith, but also the game of pool as well as other games in which a plurality of balls are positioned on the surface of a table by a rack or other similar device. In such game of billiards, pool, etc., it is often desirable to store the balls and rack in such a manner as they are not visible on the surface of the billiard table. One situation where this is convenient and desirable is where the owner of the table either in a private home or athletic hall setting does not wish to invite chance or unauthorized use of the table. One device to accomplish this overall objective and known by applicant is the device shown in U.S. Pat. No. 1,887,552 issued Nov. 15, 1932 to Gunn. Such Gunn patent shows a storable removable rack that is part of a hangable window frame when not in use. Such device also while facilitating ball spotting does not provide for the storage of a conventional rack and is generally unwieldy and cumbersome. There, accordingly, remains a need for a device of this overall type in which both the rack and balls of such games may be conveniently both cooperatively and separately stored and still satisfactorily function in a quick and easy manner to spot balls on such associated tables.

Another recurring problem with billiards and similar ball games is that it is desirable to have a carrying case in which one's own personal balls and rack may be conveniently carried. While temporary cases or packages for holding balls or balls in combination with a spotting rack are known, such normally are associated either with the point of sale or in association or supported by the billiard or pool table itself. Examples of such structures are those shown in the following patents: U.S. Pat. No. 4,103,773 issued Aug. 1, 1978 to Haber which shows a point of sale combination package and rack for pool balls; U.S. Pat. No. 3,627,321 issued Dec. 14, 1971 to Sardo which discloses a ball rack for pool and billiards in which a removable bottom enables use of the rack for temporary movement of the balls and rack from underneath the table to a position on the top surface thereof while U.S. Pat. No. 3,929,333 issued Dec. 30, 1975 to Kremski shows a somewhat similar arrangement in which a carrier for the rack and balls is provided to transport them from a position associated with the table where they may receive return balls and a position on the upper surface thereof such that the device may be used in facilitating positioning of the balls. While these above-discussed patents disclose various packages and transport aids, there remains a need for a device of this general nature which not only can serve both to position and remove balls from a billiard or similar game table but can also serve as the storage and transport device for such rack and balls without the need of an associated table such that the balls and racks could be, in essence, permanently stored or transported to distant locations when games are being played in other homes, neighborhoods, or cities.

The above and other objects of the present invention are accomplished by the billiard ball and rack storage case of the present invention which includes a box-like easily movable cover having an open bottom and an open side. A triangularly-shaped rack for receiving, spotting, and storing a plurality of billiard balls is insertable through the bottom opening of the cover and suspended in position on the cover by holding means. The lower edges of the opposed walls of the cover include opposed tracks for receiving a slidable bottom wall for positively retaining the ball rack and balls in the cover for storage and the like in such a manner that the rack and balls are snugly received therein.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 2:
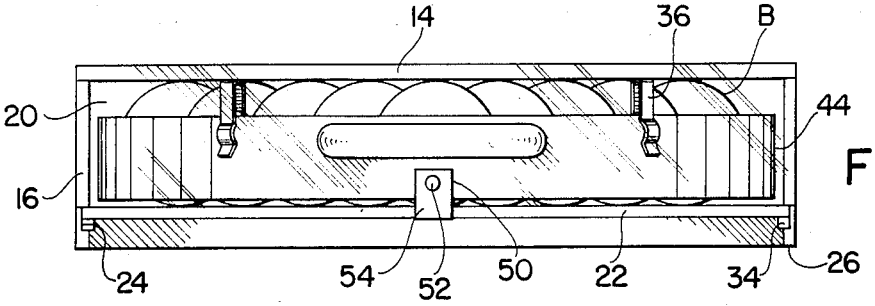
FIG. 2 is a front elevational view thereof.
Figure 4:
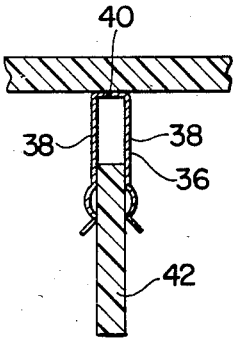
FIG. 4 is a partial sectional view taken along the line 4—4 of the FIG. 1.
Figure 1:
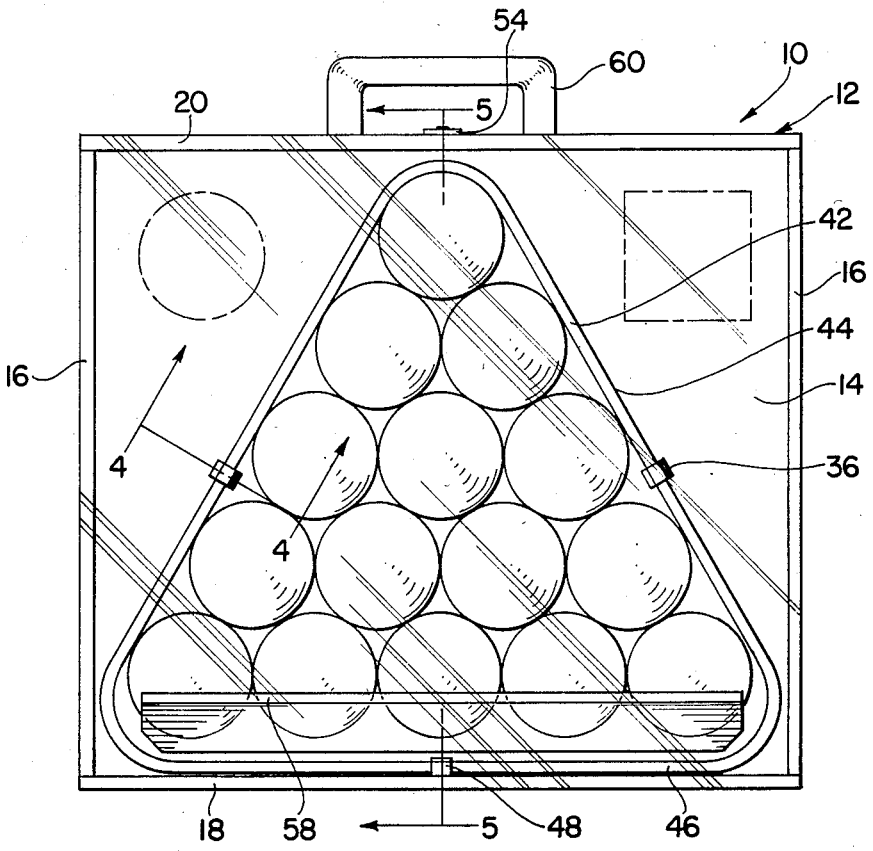
FIG. 1 is a top plan view of the device of the present invention showing a billiard rack and a set of fifteen billiard balls stored therein in the intended manner.
Figure 3:
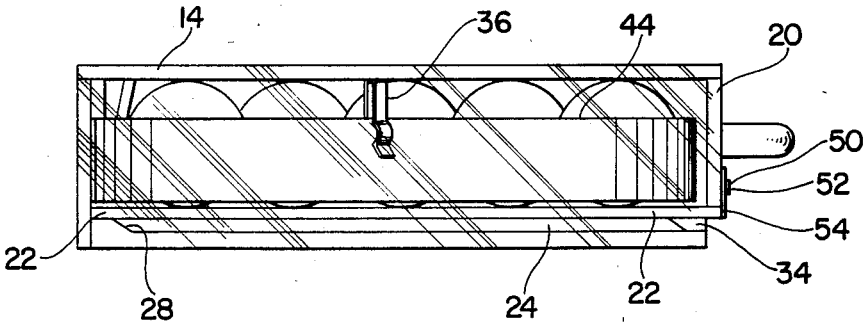
FIG. 3 is a side elevational view.

Turning now to the drawings and particularly FIGS. 1 through 3 thereof, the storage case 10 of the present invention is depicted. Such case includes a box-like cover 12 formed of transparent or translucent material such as a suitable plastic material including acrylic, polystyrene, etc. such that the rack and balls contained therein may preferably be clearly visible from the outside thereof so as to facilitate the objectives of the invention. Such cover 12 includes a top wall 14 from which side walls 16, an end wall 18 and a front wall 20 downwardly depend. The various above-described walls may be affixed to each other by conventional means where they come in abutting contact such as by adhesive connection, ultrasonic connection, or screws and the like. In essence then the cooperating walls 14, 16, 18, and 20 form overall box-like configuration of the cover 12.

Figure 6:
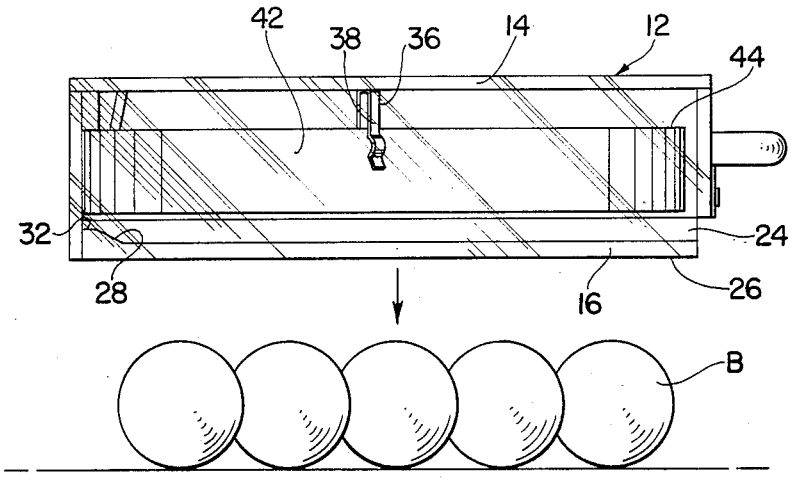
FIGS. 6 and 7 are sequential side elevational views similar to FIG. 3 but showing the manner in which the device of the present invention may be utilized to pick up and store both the rack and billiard balls from the surface of the billiard table.
Figure 7:
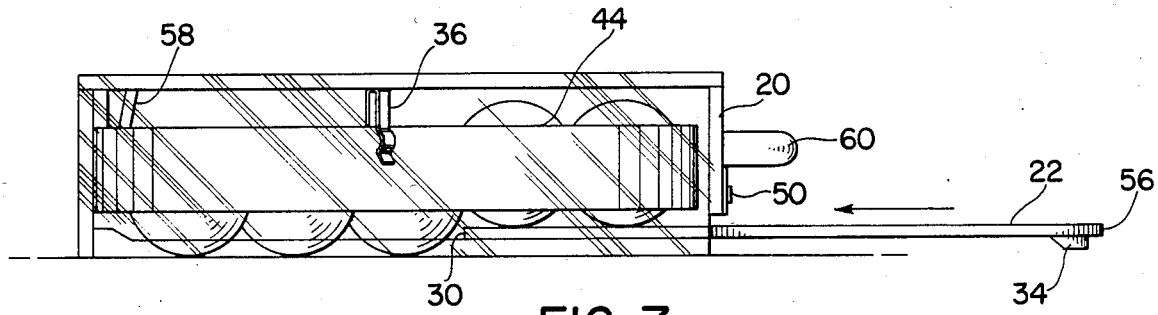

As may best be seen from reference to FIGS. 6 and 7, the open bottom of the cover 12 is adapted to be closed by a sliding bottom wall 22 adapted to be received in opposed-shaded grooves 24 disposed in the opposed side walls 16. In essence the open bottom cover is positioned over the balls B and thereafter moved downwardly into contact with the table whereupon the bottom cover 22 is slidably moved in contact with the grooves 24 so as to progressively contact the balls B and close the open bottom of the cover 12. The grooves 24 are spaced above the bottom edges 26 of the walls 16 and are of a vertical height substantially larger than the thickness of the bottom wall 22. The rear end of each groove is provided with a ramp 28 which the forward end 30 of the slidable bottom wall 22 is adapted to ride up upon and to ultimately rest on a level ledge 32 in its closed position. The forward end of the bottom wall 22 is provided with a downwardly extending block or foot 34 which is preferably ramp-shaped as well and which is adapted to contact front portions of the grooves 24 so as to position the bottom wall 22 vertically higher in its final position such as shown in FIG. 3. Thus the height of the block 34 and the ramp 28 are approximately equal such that the bottom wall 22 is level in its final position as shown in FIG. 3 than in its initial positions. The lifting motion of the slide 22 at the end of its inward travel enables the balls B to be moved from an initial position wherein they are slightly spaced from the bottom surface of the top wall 14 to a position where they approach contact with or preferably slightly contact such wall. This insures that the balls will not vertically move about the cover in the storage or use position.

The under surface of the top wall 14 is provided with at least a pair of laterally opposed downwardly extending spring clips 36 of generally U-shaped configuration and including opposed spring fingers 38 and an interconnecting base wall 40 in turn connected to the under surface of wall 14 by conventional means includng adhesive connection and connection by screws and the like. The spring members 36 are adapted to receive the opposed side walls 42 of a rack 44 so as to temporarily affix the rack 44 within the confines of the cover 12. An additional spring member 36 may be positioned at the base position of the rack 44 corresponding with the base wall 46 thereof or alternatively a block 48 outwardly extending from the rear wall 18 at the upper edge thereof may be utilized to abuttingly contact the base wall 46 of the rack 44. Alternatively other means other than the spring clips 36 may be utilized to position the rack within the cover and in a position preferably downwardly spaced from the upper wall 14 thereof. Such means may include further downwardly extending blocks (not shown) in place of the spring members 36 positioned in relationship to the other block 48 such that the rack is held in frictional contact therebetween. The essential feature in regard to this rack holding means either formed by spring clips 36 as shown or a combination of spring clips and blocks or blocks alone is that the rack 44 is positioned within the over 12 in a secure manner yet in a manner which enables the rack to be easily removed therefrom when desired.

It may thus be seen by sequential reference to FIGS. 6, 7, and 3 that with the rack 44 positioned within the cover 12, that the balls having either been previously racked when the rack was separated from the cover or racked while the rack is positioned with the cover are adapted to be enclosed by the downward movement of the cover as shown in the transition between FIGS. 6 and 7. With the balls therein positioned within the rack, the slidable bottom wall is initially moved beneath the front wall 20 which is foreshortened to facilitate such movement and then progressively slid inwardly or rearwardly to the left as shown in FIG. 7. Initially the front end 30 of the bottom wall 22 contacts the balls B and forces them slightly upward until that point at which the front end 30 of the bottom wall 22 contacts the ramp 28 and thereafter moves upwardly into its fully closed position onto ledge 32. With such upward vertical movement, the block 34 also contacts the forward portion of the grooves 24 and thus raises the bottom wall 22 to its most upward position thereby insuring that the balls B contact under portions of the upper wall 14. The dimensions of the groove 24 as well as the ramp and block as well as the side walls 16 are such that standard billiard balls B will preferably be forced into slight contact with the wall 14 to insure that do not vertically rattle about in the closed position as shown in FIG. 3. In order to retain the closed position of the slide 22, a locking means 50 is provided on the front wall 20. Such locking means include a pivot pin 52 about which a keeper 54 may eccentrically at least partially revolve such that in its upper unlocked position as shown in FIGS. 6 and 7, the slidable bottom wall is free to pass thereby whereas in its partially rotated locking position as shown in FIG. 3, it abuttingly contacts the outer rear edge 56 of the bottom wall 22 to insure that it is not unintentionally displaced from its storage position. The reverse of the above-indicated procedure is used when the storage case containing the balls and rack is to be used to position "spot" balls on the table.

In order to further insure that the balls do not undesirably move about or rattle in the storage position, a plate 50 downwardly rearwardly extending from the top wall 14 is provided at the rear thereof. Such plate laterally extends across the rear of the cover 12 generally parallel to the rear wall 18 but displaced therefrom such that when the rack 44 is positioned within the cover, the plate 58 extends downwardly within the confines of the rack proximal to the rear wall 46 thereof. The lateral extent of the plate 58 is such that it will contact each of the balls B in the rear line thereof. In this way then as the balls are gently urged to the left as shown in the drawings by the inward sliding motion of the lower wall 22, they are forced to contact the plate 58 such that they are, in effect, forwardly urged against the opposed side walls 42 of the rack 44 and thus insure that the balls B will not rattle back and forth in a horizontal attitude.

Figure 5:
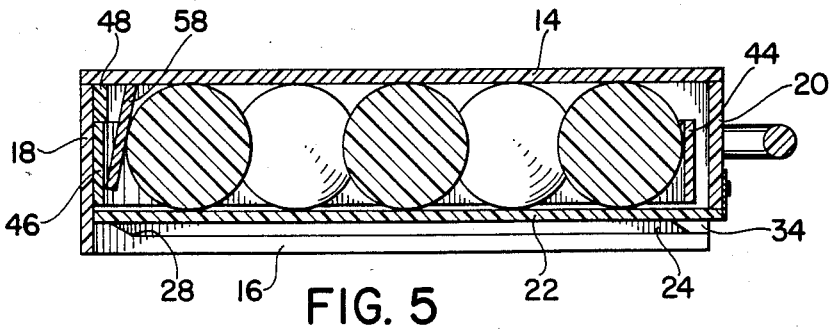
FIG. 5 is a side sectional view similar to FIG. 3 but taken along the line 5—5 of FIG. 1.

A handle 60 of generally U-shaped conventional configuration is preferably provided by suitable conventional attachment to the front wall 20 such that when the balls and rack are disposed within the cover in the desired manner as shown by FIGS. 3 and 5, that the case 10 of the present invention may be conveniently transported. In such storage position, the case 10 provides the means whereby the balls and rack and safely stored. The case 10 may be stored in either an upright position as shown in FIG. 1 or in a flat position as shown in the other views. It should also be pointed out that the bottom wall 22 may be provided with stops (not shown) to prevent it from coming all the way out of the grooves 24 if desired. It should also be pointed out that the bottom sliding wall may also be provided with a depression in the approximate position as shown by the circular phantom lines in FIG. 1 so as to accommodate the larger diameter cue ball. In this regard it should be pointed out that since the cue ball is of a larger height, that the depression or pocket into which it is received and formulated into the sliding bottom wall 22 is dimensioned such that when the wall 22 is in its forward or storage position that the cue ball as well is forced into slight contact with the upper wall 14. The sliding bottom wall 22 may also be provided with a compartment either open or closed top as may be desired on that portion thereof opposite to which the cue ball depression is disposed and roughly approximating the phantom rectangular line box shown in FIG. 1.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination billiard ball and rack storage case comprising a box-like cover having a top wall and side, front, and rear walls downwardly extending therefrom and an open bottom closeable by a slidable bottom wall inwardly movable towards said rear wall and outwardly movable past said front wall in a generally horizontally oriented attitude when said cover is similarly horizontally disposed, a pair of laterally opposed horizontally oriented grooves disposed in said side walls for slidably receiving said bottom wall, said grooves of a vertical height substantially greater than the vertical thickness of said bottom wall and means for releasably positioning a billiard rack within said cover at a position vertically above said grooves, said grooves including means for elevating said bottom wall at the end of its inward travel whereby said bottom wall will initially contact and slightly elevate balls from the table during its initial inward travel and thereafter at the end of its travel further elevate said balls into contact with said upper walls, said elevating means comprising first elevating means in the form of an elevated ramp at the end of each of said grooves.

2. A combination billiard ball and rack storage case comprising a box-like cover having a top wall and side, front, and rear walls downwardly extending therefrom and an open bottom closeable by a slidable bottom wall inwardly movable towards said rear wall and outwardly movable past said front wall in a generally horizontally oriented attitude when said cover is similarly horizontally disposed, a pair of laterally opposed horizontally oriented grooves disposed in said side walls for slidably receiving said bottom wall, said grooves of a vertical height substantially greater than the vetical thickness of said bottom wall and means for releasably positioning a billiard rack within said cover at a position vertically above said grooves, said grooves including means for elevating said bottom wall at the end of its inward travel whereby said bottom wall will initially contact and slightly elevate balls from the table during its initial inward travel and thereafter at the end of its travel further elevate said balls into contact with said upper walls, said slidable bottom wall having second elevating means comprising a block positioned at its lower front surface at lateral sides thereof which blocks contact said grooves at the end of said bottom wall inward travel.

3. A combination billiard ball and rack storage case comprising a box-like cover having a top wall and side, front, and rear walls downwardly extending therefrom and an open bottom closeable by a slidable bottom wall inwardly movable towards said rear wall and outwardly movable past said front wall in a generally horizontally oriented attitude when said cover is similarly horizontally disposed, a pair of laterally opposed horizontally oriented grooves disposed in said side walls for slidably receiving said bottom wall, said grooves of a vertical height substantially greater than the vertical thickness of said bottom wall and means for releasably positioning a billiard rack within said cover at a postion vertically above said grooves, and including sperate means for restraining said balls from both horizontal and vertical movement while retained in said cover, said means for restraining horizontal movement of said balls comprising a laterally extending plate extending downwardly inwardly into said rack from said top wall towards said rear wall and adapted to contact the rear row of balls within said rack so as to urge them forward into contact with the remaining portions of said rack, and wherein said rack is a standard triangularly-shaped rack having a base wall and two interconnected forwardly disposed side walls, said means for holding said rack comprising essentially U-shaped spring clips downwardly extending from said top wall and adapted to receive at least portions of said rack side walls therein.

4. A combination billiard ball and rack storage case comprising a box-like cover having a top wall and side, front, and rear walls downwardly extending therefrom and an open bottom closeable by a slidable bottom wall inwardly movable towards said rear wall and outwardly movable past said front wall in a generally horizontally oriented attitude when said cover is similarly horizontally disposed, a pair of laterally opposed horizontally oriented grooves disposed in said side walls for slidably receiving said bottom wall, said grooves of a vertical height substantially greater than the vertical thickness of said bottom wall and means for releasably positioning a billiard rack within said cover at a position vertically above said grooves, said grooves including means for elevating said bottom wall at the end of its inward travel whereby said bottom wall will initially contact and slightly elevate balls from the table during its initial inward travel and thereafter at the end of its travel further elevate said balls into contact with said upper wall, wherein said means for holding said rack comprises essentially U-shaped spring clips downwardly extending from said top wall and adapted to receive at least portions of said rack side walls therein.

* * * * *